US006406140B1

(12) United States Patent
Wotton et al.

(10) Patent No.: US 6,406,140 B1
(45) Date of Patent: Jun. 18, 2002

(54) ANISOTROPIC THERMAL CONDUCTIVITY ON A HEATED PLATEN

(75) Inventors: Geoff Wotton, Battle Ground; Robert M. Yraceburu, Camas; Steve O Rasmussen, Vancouver, all of WA (US); Steven B Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/733,335

(22) Filed: Dec. 8, 2000

(51) Int. Cl.[7] ..... B41J 2/01

(52) U.S. Cl. ..... 347/102

(58) Field of Search ..... 347/101, 102, 347/103; 349/320; 346/25; 219/216; 101/488; 34/304, 381

(56) References Cited

U.S. PATENT DOCUMENTS

| | | | |
|---|---|---|---|
| 4,264,293 | A | 4/1981 | Rourke |
| 4,269,586 | A | 5/1981 | Ronayne |
| 4,751,528 | A | 6/1988 | Spehrley, Jr. et al. |
| 5,023,111 | A | 6/1991 | Fulton et al. |
| 5,037,079 | A | 8/1991 | Siegel et al. |
| 5,105,204 | A | 4/1992 | Hoisington et al. |
| 5,114,747 | A | 5/1992 | Fulton et al. |
| 5,281,442 | A | 1/1994 | Fulton et al. |
| 5,504,562 | A | 4/1996 | Velazquez |
| 5,510,822 | A | 4/1996 | Vincent et al. |
| 5,668,584 | A | 9/1997 | Broder et al. |
| 5,980,981 | A | 11/1999 | Fulton et al. |

*Primary Examiner*—Raquel Yvette Gordon

(57) ABSTRACT

Anisotropic thermal conditioning of print media is provided for liquid colorant printing, such as in ink-jet hard copy apparatus, by establishing discrete temperature zones across a platen surface. Heat transfer mechanisms associated with individually selectable heater elements rapidly establish substantially uniform temperature profiles in each zone.

36 Claims, 8 Drawing Sheets

ANISOTROPIC THERMAL CONDUCTIVITY ON A HEATED PLATEN

BACKGROUND OF THE INVENTION

1. Field of the Invention

The present invention relates generally to hard copy apparatus, more specifically to conductive heating of print media, and particularly to the heating of print media that is advancing through the printing zone of an ink-jet printer.

2. Description of the Related Art

The art of ink-jet technology is relatively well developed. Commercial products such as computer printers, graphics plotters, copiers, facsimile machines, and multifunctional peripheral ("MFP") hard copy apparatus employ ink-jet technology for producing hard copy. The basics of this technology are disclosed in various articles in the *Hewlett-Packard Journal*, for example, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992, and Vol. 45, No. 1 (February 1994) editions. Ink-Jet devices are also describe by W. L. Lloyd and H. T. Taub in *Output Hardcopy Devices*, chapter 13 (Ed. R.C. Durbeck and S. Sherr, Academic Press, San Diego, 1988).

In order to simplify the description of the present invention the term "paper" is used as synonymous with all types of print media; the term "ink" is used as synonymous with all compositions of colorant; the term "pen" is used as synonymous with all types of ink-jet writing instruments. While the present invention is described for convenience in terms of application to ink-jet printing, it is to be recognized by those skilled in the art that many of the concepts are applicable to any hard copy apparatus using a wet colorant for creating a print. No limitations on the scope of the invention are intended nor should any be implied.

One important factor affecting the print quality of ink-jet printers is drying time. Print media movement must be controlled to ensure that the liquid ink dries properly once printed. Bleed of one color into another can occur when two wet droplets come into contact. Any touching of the printed surface before the ink is dry can result in smearing. An additional concern is paper cockle, which is an uncontrolled, localized warping of the paper that occurs as liquid ink saturates the fibers.

Active heating devices can be and are used to heat a printing sheet in order to speed the drying time. However, heat must be applied carefully to avoid the introduction of other problems. For example, the paper can be scorched. Furthermore, if heat is not applied correctly, the resultant uneven drying time of a color area of an image can produce undesirable variations in the hue characteristics, known as hue shift. Another problem attributable to improperly applying heat is a noticeable warping of the sheet. Normally, paper carries at least some moisture content. For example, a sealed ream of standard office paper has about 4.5-percent moisture content. High ambient humidity can increase the moisture content as the paper sheets lie in an intray. As heat is applied to part of the paper, uneven drying and shrinkage occurs. Uneven shrinkage causes the paper to warp. Some print media, such as polyester-based transparencies, will carry insignificant amounts of water and, therefore, will not buckle a s a result of uneven shrinkage. Such media, however, may warp or even burn if all or portions of it are overheated. Thus, uniform, controlled heating of the media is important for high print quality, irrespective of the type of print media.

A METHOD OF MULTIPLE ZONE HEATING OF INK-JET MEDIA USING A SCREEN PLATEN is taught in U.S. Pat. No. 5,668,584 by Broder et al., i s sued Sep. 16, 1997 (assigned to the common assignee herein and incorporated by reference). Pre-printing, print zone, and post-printing heating is shown using an open screen type platen. Other specific methods and apparatus for CONDUCTIVE HEATING OF PRINT MEDIA is described by common inventor Wotton et al., in U.S. patent application Ser. No. 09/1412842, filed Oct. 5, 1999 ("Wotton et al." hereinafter), co-pending herewith, assigned to the common assignee herein, and incorporated herein by reference in it s entirety, particularly discussing vacuum holddown type platen technology.

If heat is to be applied to the print sheet, it is useful to have it in the print zone. Heating in the print zone rapidly drives off a substantial portion of the liquid component of the ink so that cockle is unable to form, or at least is minimized. However, when one attempts to heat the media in the print zone, it is important to ensure that the applied heat is not directed into the printhead. If an ink-jet printhead overheats, drop trajectory and other characteristics of the printhead can change, again negatively affecting print quality. Moreover, the heat should not be applied in a manner, such as by convection, that itself may directly alter droplet trajectory.

Another prior art solution is shown by Vincent et al. in U.S. Pat. No. 5,510,822, issued Apr. 23, 1996 for an INK-JET PRINTER WITH HEATED PRINT ZONE (assigned to the common assignee herein and incorporated by reference).

A close study of the thermodynamics of a print zone heater has shown that the problem is more complex than previously thought. Along the x-axis, some of the thermal loads that can cause a temperature imbalance include paper type and size, ink composition and presence or absence (i.e., dotted and not-dotted pixels) in regions of the printing sheet, and airflow such as occurs when using a vacuum-type platen as in Wotton et al. It has been found that airflow near the edge of the printing sheet creates the largest thermal load. This load has been found to create temperatures drops near the edge of as much as 30-degrees Centigrade. Edge-to-edge printing, known as full bleed further exacerbates the problem. At the same time, as a variety of different sized media is usually used in a printer, the edge of the sheet from page to page may be indeterminate. Thus, the load position from airflow near the edge of the paper is a variable factor. Therefore, there is a need for method and apparatus to provide substantially infinitely adjustable power densities along the x-axis in order to ensure a uniform temperature profile.

One solution is to have a very fine heater resolution. However, such is expensive in and of itself and also requires extensive control subsystems.

It has been found that anisotropic thermal conductivity on a heated platen, i.e., having different levels of thermal conductivity in the x-axis, y-axis, and z-axis, provides significant advantages and advancement in the state of the art.

GLOSSARY

As used herein, the term "high thermal conductivity" shall mean: greater than approximately one-hundred (100) W/m.K (Watts/meter Kelvin). An example of a material having a relatively high thermal conductivity is aluminum.

As used herein, the term "low thermal conductivity" shall mean: less than approximately ten (10) W/m.K. An example of a material having relatively low thermal conductivity is plastic.

As used herein, for operating temperatures between about 40° C. and 150° C., the term "high thermal resistance" shall mean:

in the y-axis, surface temperature change ($\Delta T/L_Y$) $\geqq$1.0° C./mm for surface temperature changes of up to 90° C. between two points; and in the z-axis, $Power_{watts\ z\text{-}axis} \leqq 0.15\ Power_{watts\ total}$.

As used herein, the term "low thermal resistance" shall mean: length÷thermal conductivity>fifteen percent heat flow (or power flow in Watts).

As used herein, the term "high thermal mass" shall mean: a mass having a response time of greater than 60 seconds to change temperature by 100° C.; or, as a calculable $m \cdot C_p$ (mass-specific heat), a specific implementation contemplated by the inventors being $m \cdot C_p \geqq 1200$ J/K (Joules/ Kelvin). A preferred implementation (an example of a component in the current context having a relatively high thermal mass would be the entire platen 42) should have a response time measured in minutes rather than seconds.

As used herein, the term "low thermal mass" shall mean: a mass having a response time of less than 30 seconds to change temperature by 100° C.; as a calculable $m \cdot C_p$ (mass-specific heat), a specific implementation contemplated by the inventors being $m \cdot C_p \geqq 600$ J/K (Joules/ Kelvin), indicative of a response time measured in seconds or fractions of seconds. An example of a component in the current context having a relatively low thermal mass would be the nickel orifice plate of the printhead of a pen 115X.

As used herein, the term "power density control" shall mean: independent control of power and temperature for various platen areas and having relatively short response times.

As used herein, the term "rapid temperature change" shall mean: a temperature gradient greater than about one (1) degree Centigrade/millimeter in the paper transit axis, "y," for belt speeds of approximately$\leqq$one inch per second in a hard copy apparatus implemented for a two-hundred (200) pL fluid application for about three-hundred (300) dots per inch (dpi).

SUMMARY OF THE INVENTION

In its basic aspects, the present invention provides a method for heat treating print media, including the steps of: establishing at least two, discrete, temperature zones on a platen in a media transit axis; and transporting the media in the media transit axis in contact with the platen.

In another aspect, the present invention provides a method for anisotropically heat treating a print media to be printed with a wet colorant during transport from an input supply to an output, including the steps of: maintaining a substantially uniform temperature profile across a colorant receiving axis; and providing a plurality of temperature regions along the media transport axis wherein each of said temperature regions has a single said substantially uniform temperature profile.

In another aspect, the present invention provides a method of distributing heat anisotropically across an ink-jet platen including: substantially uniformly heating a pre-printing zone of a media transit axis to a first temperature for pre-conditioning print media; substantially uniformly heating a printing zone of a media transit axis to a second temperature for printing on the print media; and providing a cool down zone between said pre-printing zone and said printing zone.

In another aspect, the present invention provides an anisotropically heated platen apparatus, including: a heated ingress region for receiving print media superjacently thereon; and a heated printing region downstream of the ingress region for sequentially receiving the print media, wherein said ingress region is at a first predetermined temperature and said printing region is at a second predetermined temperature, said ingress region and said printing region are substantially isolated thermally such that thermal exchange therebetween is minimized.

Another aspect of the present invention is a liquid colorant print media platen apparatus, including: sequentially in a media transit axis, a first region substantially uniformly heated in orthogonal axes to a first predetermined temperature for preconditioning print media, a second region that is unheated, and a third region substantially uniformly heated in like orthogonal axes to a second predetermined temperature for depositing said colorant on the print media, wherein anisotropic print media heat conditioning occurs on said platen.

In another aspect, the present invention provides an ink-jet hard copy apparatus, having a known manner means for inducing a vacuum force, including: at least one ink-jet writing instrument for depositing ink drops onto pixels of an adjacently positioned sheet of print media; adjacent to said writing instrument, a print media platen including a thick film transport surface, having vacuum ports in a first array; mounted to the platen, individually selectable heaters in a second array interspersed with said first array; a perforated print media transport belt for sliding across said surface for carrying said sheet via vacuum adhesion sequentially from an input position to a position of being adjacently positioned to said writing instrument to an output receiver; and a controller connected to said heaters for forming at least two segregated, anisotropic, print media heating regions on said platen surface.

Some of the advantages of the present invention are:

it provides a level x-axis temperature profile regardless of media size, and media position providing a flat x-axis temperature profile promotes uniform ink drying to avoid hue shift;

providing a flat x-axis temperature profile avoids problems with edge scalloping and cockle;

providing a flat x-axis temperature profile avoids over heating conditions with respect to the pens, platen and media;

providing good power density control on the y-axis provides an improved temperature profile between preheating, cool down, print zone heating, and post-printing heating;

providing good power density control on the y-axis provides fast response time between temperature changes in a particular heating or cooling zone;

providing a limited z-axis thermal conductivity prevents heat losses from x-axis and y-axis heating, resulting in lower power consumption;

providing a limited z-axis thermal conductivity allows a faster response time due to low thermal mass design;

it reduces thermally induced impacts on ink-jet pen performance; and it provides a method and apparatus wherein temperature profiles are independent of load, thus providing a safety mechanism against overheating.

The foregoing summary and list of advantages is not intended by the inventors to be an inclusive list of all the aspects, objects, advantages, or features of the present invention nor should any limitation on the scope of the invention be implied therefrom. This Summary is provided in accordance with the mandate of 37 C.F.R. 1.73 and M.P.E.P. 608.01 (d) merely to apprise the public, and more especially those interested in the particular art to which the invention relates, of the basic nature of the invention in order to be of assistance in aiding ready understanding of the patent in future searches. Other aspects, objects, advantages, and features of the present invention will become apparent upon consideration of the following explanation and the accompanying drawings, in which like reference designations represent like features throughout the drawings.

DESCRIPTION OF THE PRESENT INVENTION

Reference is made now in detail to a specific embodiment of the present invention which illustrates the best mode presently contemplated by the inventors for practicing the invention. Alternative embodiments are also briefly described as applicable.

Figure 1A:
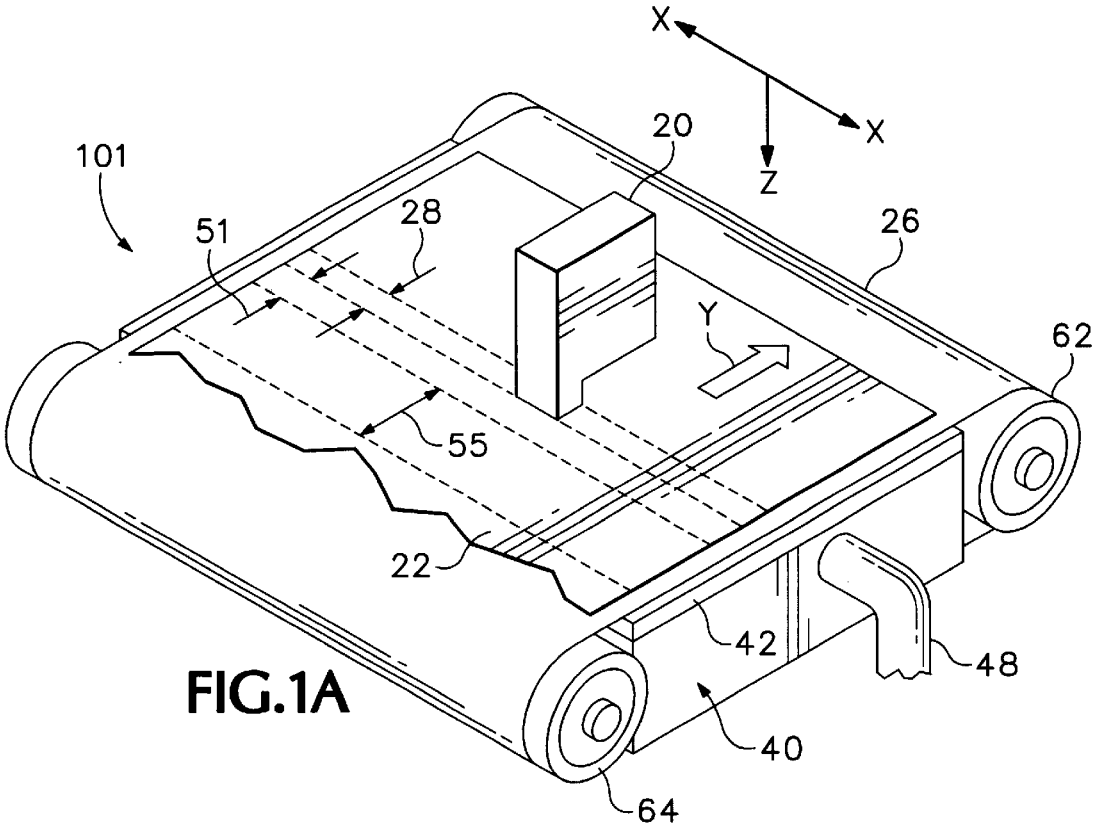
FIGS. 1A and 1B schematically depict an ink-jet hard copy apparatus implementation in accordance with the present invention.
Figure 1B:
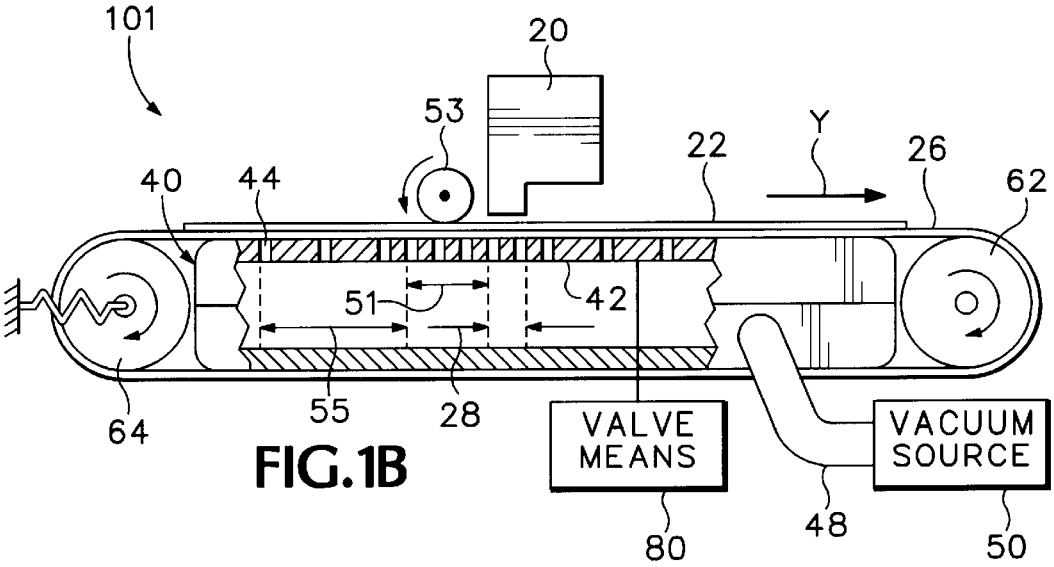

FIGS. 1A and 1B depict an ink-jet hard copy apparatus in which the present invention is useful; in this exemplary embodiment, a computer printer 101 is typified. In general, the carriage scanning axis is designated the x-axis, the print media transport axis is designated the y-axis, and the pen firing direction onto the media is designated the z-axis. Operation is administrated by an electronic controller (not shown; usually a microprocessor application specific integrated circuit ("ASIC") printed circuit board). It is well known to program and execute imaging, printing, print media handling, control functions and logic with firmware or software instructions using such a controller.

Paper sheets 22 from an input supply (not shown) are sequentially captured and fed by a vacuum belt mechanism to an internal printing station, or "print(ing) zone," 28. An endless-loop belt 26 is mounted between belt drive rollers 62, 64 in a known manner. A vacuum box 40, coupled by an appropriate conduit 48 to a vacuum source 50 (FIG. 1B only) has a platen 42 having a plurality of vacuum ports 44 (FIG. 1B only) therethrough. The belt 26 is generally porous, allowing a vacuum flow to pull through the belt via the ports 44. The paper sheet 22 is captured in an upstream (with respect to the pen 20 and associated print zone 28) support zone 55 by the vacuum force exerted thereon as the sheet is received from the input supply. In another upstream, pre-print zone 51, the sheet is engaged by a pinch roller 53 in conjunction with the belt driven by a motor (not shown) coupled to drive roller 62 for accurately positioning the sheet in the y-axis with respect to the pen 20.

In the print zone 28, one or more ink-jet pens 20 (mounted on an encoder controlled scanning carriage; not shown) scans the adjacently positioned paper sheet 22 and graphical images or alphanumeric text are created. Each pen 20 has one or more printhead mechanisms (not seen in this view) for "jetting" minute droplets of ink to form dots on adjacently positioned print media. Each minute droplet is directed at an artificially imposed row and column grid on the print media known as a picture element ("pixel") using digital dot matrix manipulation to form alphanumeric characters or graphical images. Once a printed page is completed, the print medium is ejected from the belt 26.

Figure 2:
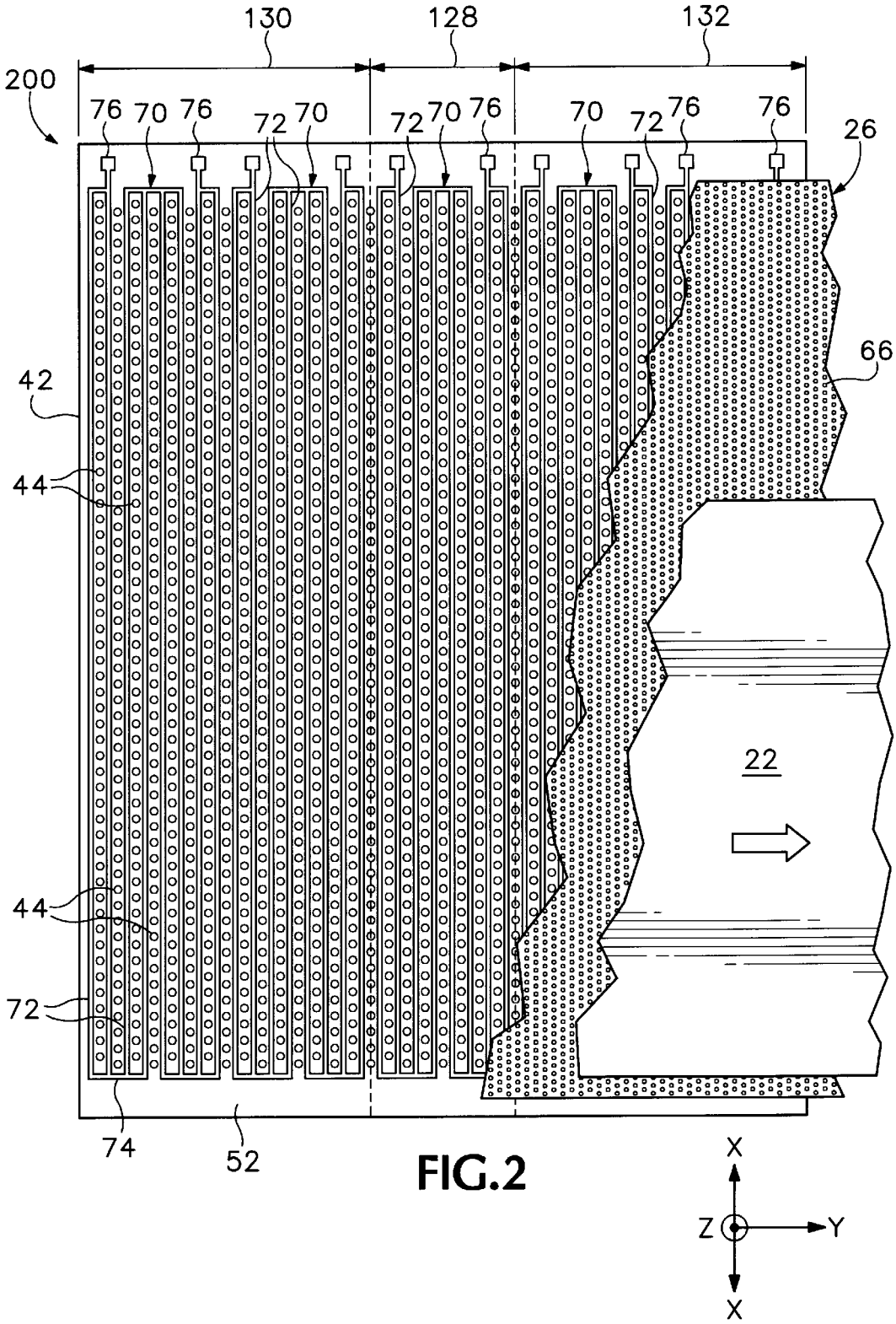
FIG. 2 is a schematic illustration of a platen in accordance with the present invention.

FIG. 2 is an exemplary embodiment of a vacuum belt subsystem 200, including a specific embodiment of a platen 42 in accordance with the present invention. A transport portion, or region, 66 of the belt 26 slides over a support surface 52 of the vacuum platen 42, having ports 44 arranged for communicating vacuum pressure to the surface 52. Paper sheets 22 are sequentially directed onto the transport portion 66 by known manner paper supply pick and feed mechanisms (not shown). Conductive heating of the belt 26 is accomplished by the use of one or more heaters 70 that are about 1-millimeter below the platen support surface 52, in this embodiment, fabricated on a ceramic substrate for conducting the applied heat. The heaters 70 are comprised of an array of linear, resistive heating elements 72 attached or printed on the support surface 52 of the ceramic. The individual heating elements 72 extend between the rows of vacuum ports 44 that are defined on the support surface 52 of the platen 42. At the edges of the support surface 52, the individual elements 72 are joined (as at reference numeral 74) and the termini of the heaters are enlarged into two contact pads 76 for connecting to a known manner source of electrical potential. The heaters 70 are arranged so that one heater resides on the central portion of the platen 42 immediately in the print zone 128. There are also two heaters 70 in the platen 42 entry region 130, referred to as "entry region heaters," viz. a pre-printing operations region. Similarly, two "exit region heaters" are provided at the exit region 132 of the platen, viz. post-printing operations region. Further details of this specific embodiment are described in the Wotton et al. CONDUCTIVE HEATING OF PRINT MEDIA application, supra; however, details other than those incorporated herein are not required in order to understand the present invention.

As stopping the printing process while the media 22 is in the heated platen print zone 28 could cause damage such as described in the Background Section, the vacuum ports 44 are provided with a selective valve mechanism 80 for selective cooling as schematically illustrated in FIG. 1B. The procedure is to use specific valves adjacently located to the edge of a specific page size being printed. When the apparatus 101 stops printing, appropriate valves are opened allowing airflow for cooling the platen under the paper. A variety of such mechanisms for valving vacuum ports are known in the art and can be adapted for specific implementations of the present invention. See e.g., assignee's co-pending applications for a PRINT MEDIA VACUUM HOLDDOWN (Rasmussen et al., Ser. No. 09/292,767), a VACUUM SURFACE FOR WET DYE HARD COPY APPARATUS (Wotton et al., Ser. No. 09/292838), a method and apparatus for HARD COPY PRINT MEDIA SIZE AND POSITION DETECTION (Hickman, Ser. No. 09/294774 (allowed)), a VACUUM CONTROL FOR VACUUM HOLDDOWN (Rhodes et al., Ser. No. 09/292125), incorporated herein by reference, or e.g., U.S. Pat. No. 5,037,079, (Siegel et al.), and the Detailed Description hereinafter with respect to the use of means, such as heat pipes, for establishing anisotropic thermal conductivity across a heated platen.

Figure 3:
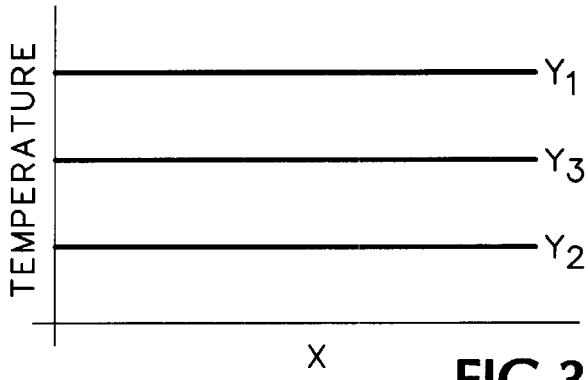
FIG. 3 is a x-axis target temperature profile ideal for the platen in accordance with the present invention as shown in FIG. 2.
Figure 4A:
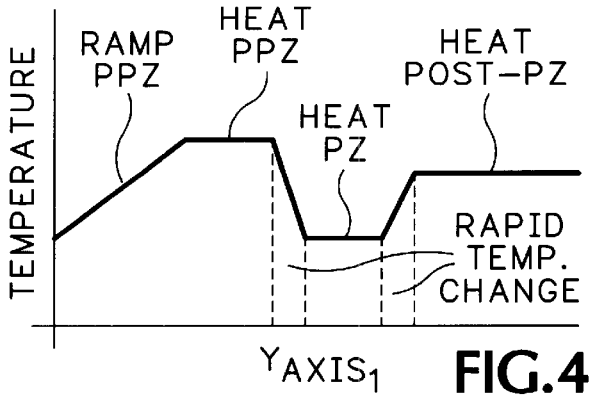
FIG. 4A is a first y-axis target temperature profile ideal for the platen in accordance with the present invention as shown in FIG. 2.

FIG. 3 is a x-axis target temperature profile ideal for the platen in accordance with the present invention as shown in FIG. 2. In the idealized method and apparatus, infinitely adjustable power density control along the x-axis is desired. Let "Y1" represents a sensor output signal representative of temperature in the x-axis in platen 42 entry region 130, pre-printing, as illustrated in FIG. 2. "Y2" represents a sensor output in the print zone 128 of FIG. 2. "Y3" represents a sensor output in the exit region 132, post-printing, of FIG. 2. In essence, it has been found that substantially constant temperature across the respective pre-printing, printing, and post-printing regions 130, 128, 132, namely in the x-axis, regardless of paper type, width and thickness, is ideal for avoiding problems attendant to the use of a wet colorant. FIG. 4A is a graph depicting a first embodiment for y-axis ($Y_{AXIS1}$) temperature profiling for the apparatus of FIG. 2. In the pre-printing zone, the media temperature is raised (RAMP, PPZ) to a first predetermined level, HEAT, PPZ, namely the temperature level associated with Y1 of FIG. 3, selected for driving off excess moisture and generally preparing a particular media 22 for the deposition of ink swaths. Generally, this first predetermined level, HEAT, PPZ, is greater than the optimal for actual printing operations. A rapid cooling (labeled "RAPID TEMPERATURE CHANGE") is therefore desired before the immediate media 22 region to be printed is in the print zone 128. One or more rows of open vacuum ports 44 (FIG. 2) between heated platen zones 130, 128 can be used to rapidly cool the media region about to enter the print zone to a second predetermined temperature level, HEAT, PPZ, namely the temperature level associated with Y2 of FIG. 3, i.e., to prevent bleed and the like print zone problems known in the art. Next, rapid drying of a printed swath is desirable to avoid smearing, cockle, and the like post-printing zone problems known in the art. A rapid reheating of the now printed media region is desirable to get that region to a third predetermined temperature level HEAT, POST-PZ, namely the temperature level associated with Y3 of FIG. 3. Thus, the y-axis control is associated closely with the type of media being printed and its relative position on the platen 42.

Figure 4B:
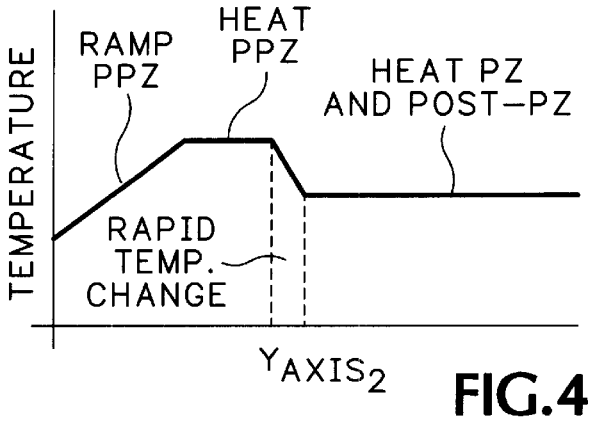
FIG. 4B is a second y-axis target temperature profile ideal for the platen in accordance with the present invention as shown in FIG. 2.

FIG. 4B is another y-axis ($Y_{AXIS2}$) target temperature idealized profile for the platen 42 in accordance with the present invention as shown in FIG. 2. It may be that for certain implementations the ideal print zone temperature and post-printing temperature can be substantially the same (HEAT, PZ=HEAT, POST-PZ) for optimal performance, Y2=Y3. Control requirements for the individual heaters 70 (FIG. 2) can therefore be reduced.

Other profiles can be generated for any particular implementation in accordance with wet colorant design factors such as deposition speed, drying time for a particular ink composition, and the like as would be known to persons skilled in the art. Assuming low thermal conductivity and good power density control in the y-axis and a low thermal mass, an ideal temperature profile can be approached, providing sufficiently fast temperature changes where needed in a specific implementation.

The apparatus described above and hereinafter can achieve non-uniform temperature profiles in the y-axis by having fine control on the y-axis heater power density and low y-axis thermal conductivity. With fine power density control, the pre-printing zone 130 is run at a high temperature to dry the media; reduced temperature in the print zone 128 optimizes ink-paper interaction. Having low y-axis thermal conductivity allows running the pre-print zone at a relatively high temperature, where $Y_1 >> Y_2$, without influencing the net temperature in the print zone 128, $Y_2$. Some traces 72, 74 can be ON via the contact pads 76 while others are left OFF, establishing discrete temperature zones in the y-axis. Similarly, if the profile of FIG. 4A is implemented, by having a low y-axis thermal conductivity device, the post-printing zone 132 predetermined temperature can be greater than the printing zone 128 temperature, $Y_3 > Y_2$, without the post-printing zone 132 temperature influencing the net temperature in the print zone 128. Additionally, low thermal mass is desired to minimize the time of the temperature excursions, labeled "RAPID TEMP CHANGE" in FIGS. 4A and 4B.

Figure 5:
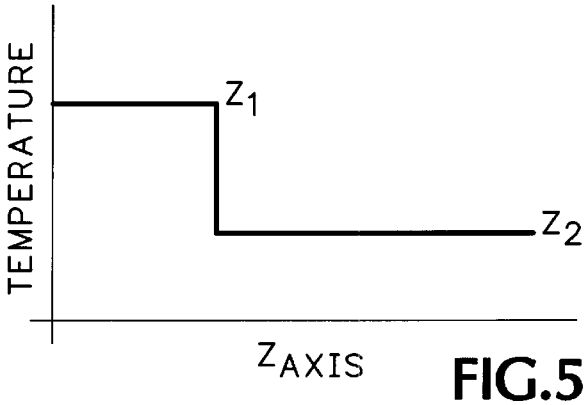
FIG. 5 is a z-axis target temperature profile ideal for the platen in accordance with the present invention as shown in FIG. 2.

FIG. 5 is a z-axis target temperature profile ideal for the platen in accordance with the present invention as shown in FIG. 2. In essence, on the z-axis the intent is to have only enough thermal conductivity to ensure sufficient x-axis heat transfer capability. Beyond satisfying this goal, additional z-axis thermal conductivity will only cause open loop power losses. Moreover, excess heating into the z-axis may cause damage to other heat-sensitive parts in the immediate region of the platen. Therefore a substantially constant predetermined temperature $Z_1$ at the belt-contact surface 52 (FIG. 2) of the platen 42 is desired. A subjacent surface to the ceramic-based heaters 70, basically any good thermal insulator material, such as a poly-foam, should have very high thermal resistance, maintaining a substantially constant temperature $Z_2$, where $Z_2 << Z_1$. Note that $Z_2$ may exhibit some positive fluctuation, saving power and improving response time of the heater.

Figure 6:
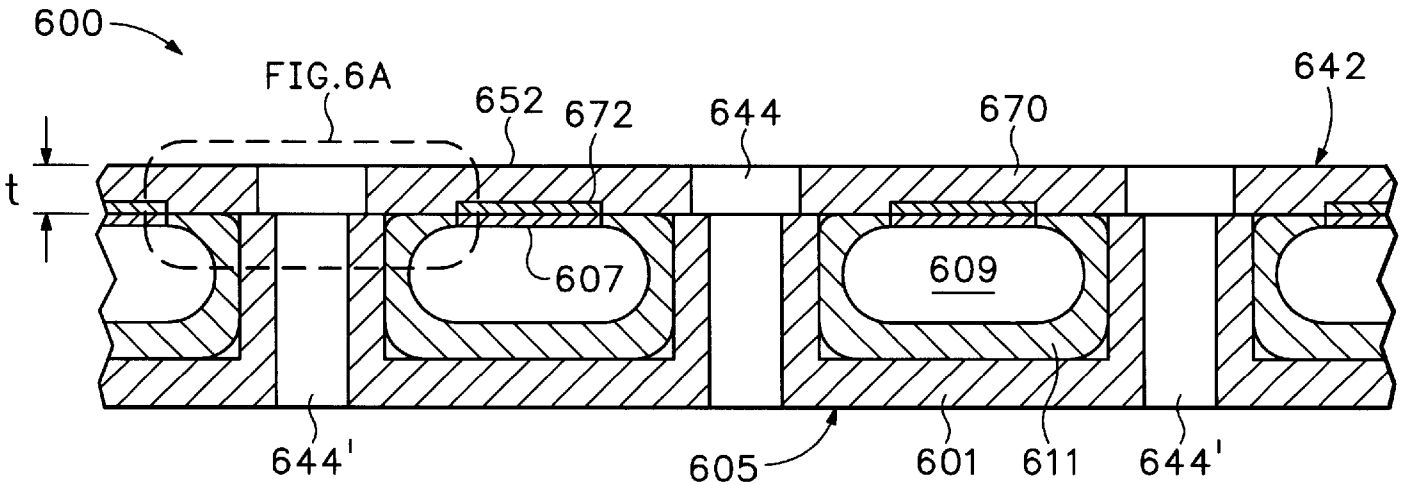
FIG. 6 is a first embodiment of an anisotropic heated platen in accordance with the present invention, schematically illustrated in a cross-sectional, elevation view.
Figure 6A:
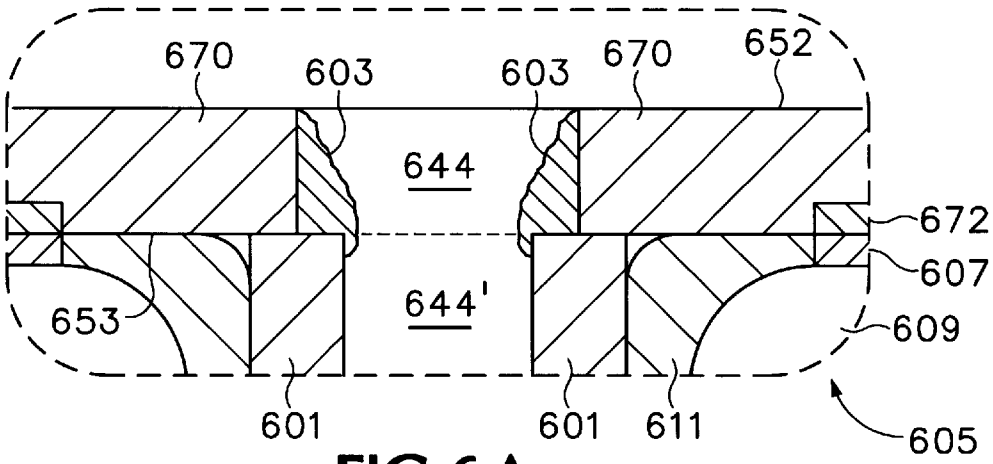
FIG. 6A is a detail enlargement of FIG. 6.

FIGS. 6 and 6A are a first embodiment of an anisotropic platen 600 construct in accordance with the present invention using heat pipes (where similar or identical in function to the elements in FIGS. 1A–1B and 2, the elements of the embodiments described hereinafter are given the same number with a prefix "6," "7," et seq.) A vacuum platen holddown-heater 642 member, having a plurality of vacuum ports 644, has a belt-bearing surface 652 for allowing a perforated transport belt 26, FIG. 2 only, to slide across. Preferably the holddown-heater 642 is of a low thermal resistance, ceramic material having a thickness, "t," of approximately one millimeter (thermal conductivity of approximately 30 W/m.K). The underside 653 (FIG. 6A) of the holddown-heater 642 bears a plurality of individually controlled heaters 670 having heater elements 672 (printed metallic traces approximately 0.05 mm thick) via contact pads 76 (as shown in FIG. 2 only). Note that the traces 672 can also be on the support surface 652 itself.

A low thermal conductivity frame 601 is mounted in a conventional manner subjacently to the holddown-heater 642. In a preferred embodiment the frame 601 is fabricated of a plastic such as a liquid crystal polymer ("LCP"), a polyimide such as ULTEM™, commercially available from General Electric company of Pittsfield, Mass., or a polyphenelene sulfide ("PPS"). The frame 601 has a plurality of corresponding vacuum ports 644' aligned with the vacuum ports 644 of the holddown-heater 642. In the preferred embodiment, a glue or caulk, such as a high temperature silicone adhesive (commercially available from Dow, General Electric, 3M or Toshiba) can be employed as a seal 603 (FIG. 6A only) to couple the holddown-heater 642 to the frame 601 and to prevent lateral heat loss from the holddown-heater 642 via the sides of the vacuum ports 644 by isolating heated surfaces from the vacuum airflow.

The frame 601 also has a plurality of cavities 605, one subjacent to each trace 672. A thermally conductive, CTE mismatch absorbing, adhesive, 607 such as Bondply 100 PSA, manufactured by Berquist company of Minneapolis, Minn., is preferably used to adjoin a heat pipe 609 to each heater 670 trace so that a maximum heat transfer interface is created. Heat pipes which can be employed in accordance with the present invention are commercially available from Furukawa company of Japan. The heat pipes 609 run in the y-axis across the holddown-heater 642. Each heat pipe 609 is preferably insulated by a surrounding low thermal conductivity element such as air, glue, foam, or other known manner thermal insulation 611.

In operation, the anisotropic platen 600 construct has three layers. The belt-bearing layer is the heat source; in the main a thick film substrate with thick film circuits printed on it. Subjacent to the belt-bearing layer is the heat pipe subsystem for rapidly transferring heat in the x-axis across the platen surface 652. Subjacent the heat pipe subsystem is an insulating layer. To maintain a substantially uniform x-axis temperature (see FIG. 3), the heat pipes 609 run the length of the width of the platen 600 construct. To maintain a set of zones having different temperatures in the y-axis (see e.g., FIGS. 4A or 4B), the heat source thick film substrate, viz. the holddown-heater 642, is made as thin as practicable (e.g., a ceramic material, about one millimeter thick); the heat pipes 609 are surrounded by a frame 601 with a good thermal insulating characteristic and preferably insulation 611 within the frame.

Figure 7:
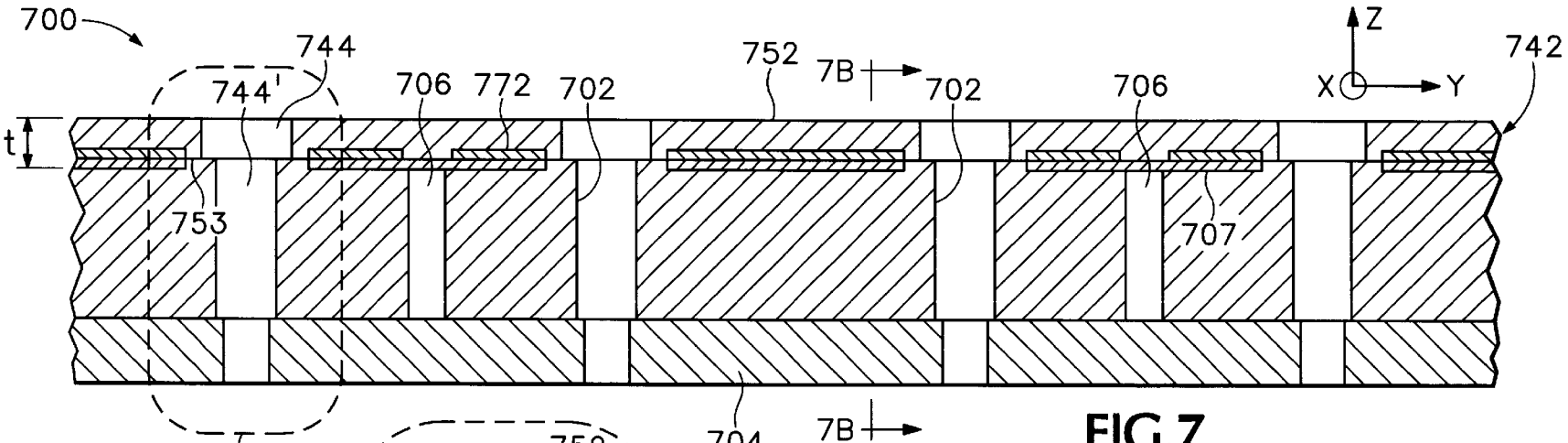
FIG. 7 is a second embodiment of an anisotropic heated platen in accordance with the present invention, schematically illustrated in a cross-sectional, elevation view.
Figure 7B:
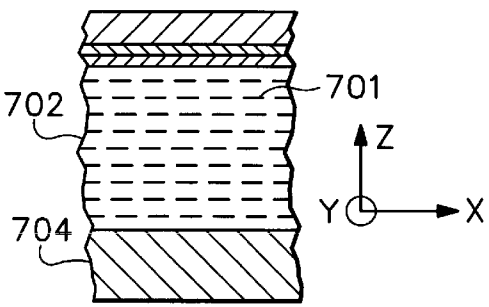
FIG. 7B shows details with respect to cross-section A—A of FIG. 7.
Figure 7A:
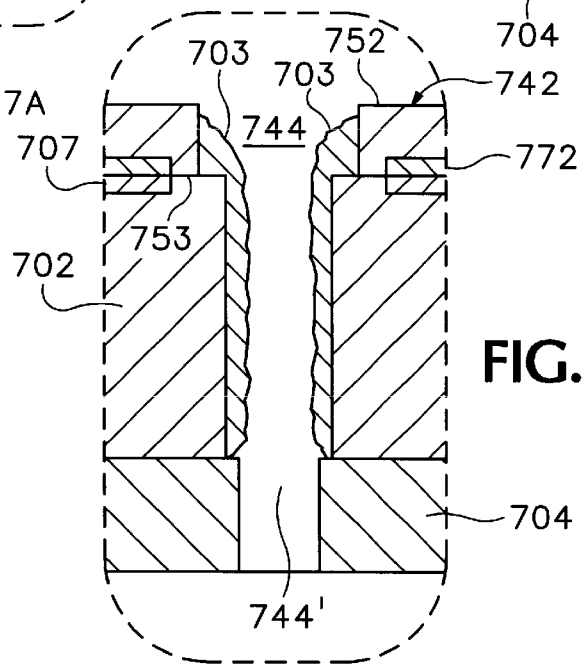
FIG. 7A is a detail enlargement of FIG. 7.

FIGS. 7 and 7A are a second embodiment of an anisotropic heated platen apparatus in accordance with the present invention using individual heater base strips separated by thermally insulating gaps to create discrete temperature zones in the y-axis. The x-axis, y-axis, and z-axis conductive characteristics as shown in FIGS. 3 through 5 are achieved in a stratified platen 700 construct.

The top layer, namely a vacuum platen holddown-heater 742 has low thermal resistance. The holddown-heater 742 has a belt support contact surface 752 which itself may be coated with a thermally conductive, low friction material such as glass. Heater traces 772 are laminated to either surface of the belt support 742, shown here representatively as thick film circuits printed on the under surface 753 of the belt support 742. The vacuum platen holddown-heater 742 has vacuum ports 744 arrayed therethrough. As with the previous embodiment, vacuum ports 744' through the subjacent layers of the platen construct 700 are aligned with the with the vacuum ports 744 of the holddown-heater 742 layer.

The middle layer of the construct is a base 702 formed of a matched CTE, high thermal conductivity material, such as silicon carbide particles and aluminum metal composite matrix, or a graphite-filled epoxy. In the main, the middle layer base 702 can be thermally conductive, molded or cast, bars that substitute for the heat pipes of the previous embodiment. It is mounted to the holddown-heater 742 with a thermally conductive adhesive 707. In the alternative, a conductively anisotropic material having a high conductivity in the x-axis and a low to moderate conductivity in the y-axis and z-axis can be fabricated by having conductive fibers 701 aligned in the x as shown in FIG. 7B, showing cross-section A—A of FIG. 7. A material such as a graphite-filled composite can be employed.

Subjacent the thermally conductive base 702 is a low thermal conductivity insulator 704. The base 702 in conjunction with the insulator 704 forms a conduit for rapid transfer of heat in the x-axis whereby the appropriate substantially uniform temperature is established.

Gaps 706 in the base 702, running in the x-axis and appropriately arrayed in the y-axis, are provided between predetermined heater zones. The gaps 706 are to be thermally insulating; therefore the gaps 706 can be filled with air or a thermal insulative material such as a poly-foam compound. The gaps 706 prevent heat from migrating between heated zones of the platen surface as described above. Also, as in the prior embodiment, a glue or caulk 703 is used as a seal in the vacuum ports 744, 744'.

In a test bed implementations, the holddown-heater layer was approximately one-millimeter thick, the base layer between two and five millimeters thick, and the insulating lowest layer was between two and ten millimeters thick. The gaps 706 were 0.25 to two millimeters in cross-section in the y-axis direction.

In operation, for the x-axis profile as demonstrated in FIG. 3, a uniform temperature is the goal. Thus, to accomplish this, individual strips of a highly thermal conductive material of the base 702 are provided to run the width of the platen 700, quickly transferring heat generated by the traces 772. Note that the strips can be connected to each other as long as the bridging material is minimal enough to prevent any significant heat transfer in the y-axis direction, leading to an isothermal condition. The y-axis dimension of the strips depends on the specific implementation's design specification for temperature resolution in the y-axis; the smaller and closer together the strips are, the finer the temperature resolution.

For the y-axis profile as demonstrated in FIGS. 4A and 4B, the air gaps 706 are positioned appropriately to break heat transfer between the pre-printing zone 130 (FIG. 2), the print zone 128, and the post-printing zone 132 and provide the RAPID TEMP CHANGE inter-zone functionality.

For the z-axis profile, the insulation 704 minimizes the draw of heat away from the holddown-heater 742; the conductive material is relatively very thin in the z-axis compared with the x-axis dimension and can be more than one hundred times less thermally conductive.

It should be recognized that a heat pipe implementation as shown in FIG. 6 can be designed also using the y-axis gap construct as shown in FIG. 7.

Figure 8:
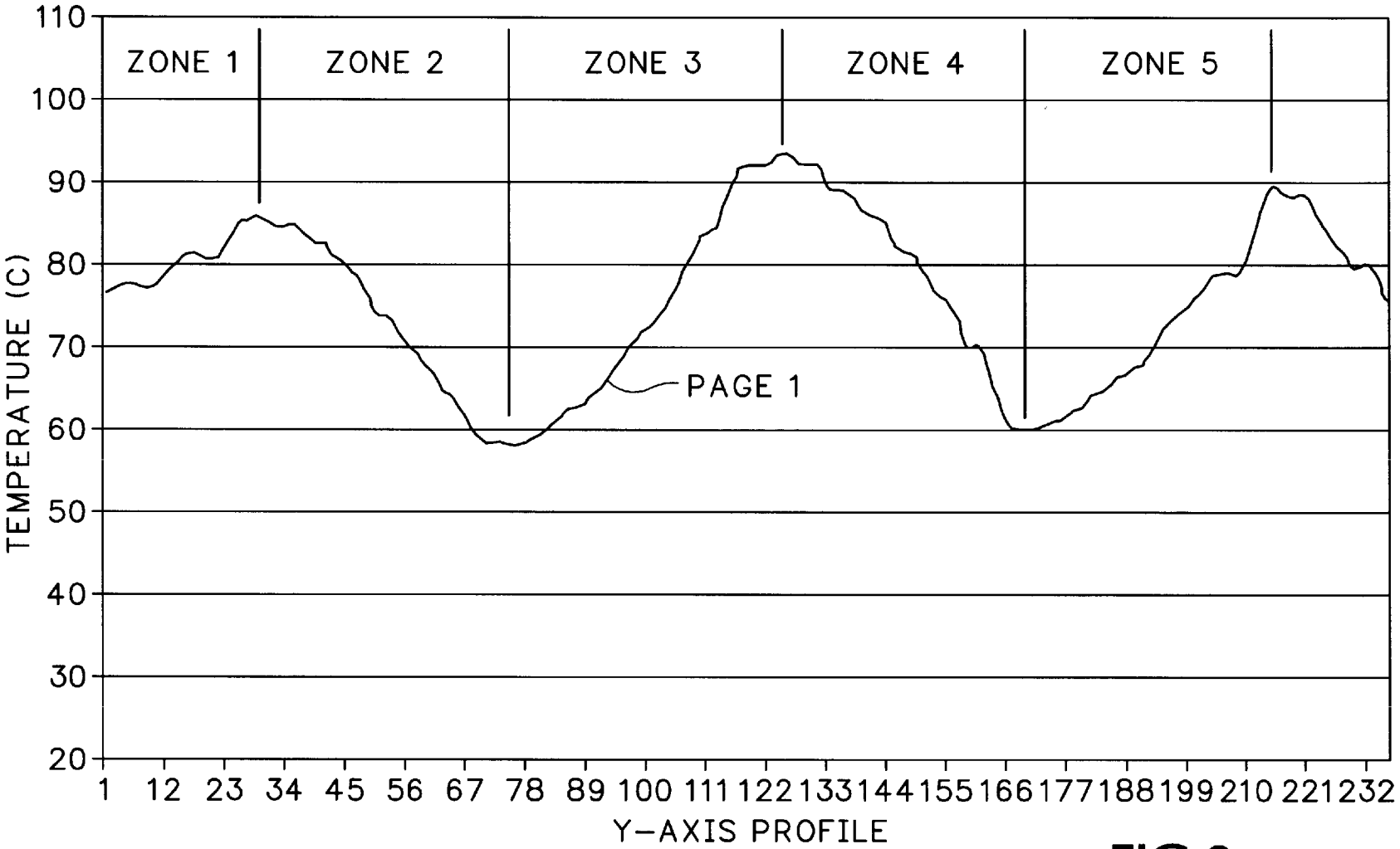
FIGS. 8A and 8B are graphs for comparison of a temperature profile of a platen not including the present invention (8A) versus a platen in accordance with the present invention (8B).

FIG. 8 is a graph of a temperature profile of a sheet of blank paper on a stainless steel (commonly referred to as INVAR™) belt 26 (FIGS. 1A–1B. 2), advancing through a test bed implementation for an embodiment as shown in FIG. 6, using heat pipes 609. A pre-printing zone Zone 1, print zone Zone 3, and post-printing zone Zone 5, heaters are ON and inter-zone Zone 2 and Zone 4 gap heaters are OFF. The graph demonstrates the ability of the structure to create a profile such as that shown in FIGS. 4A and 4B.

Figure 8A:
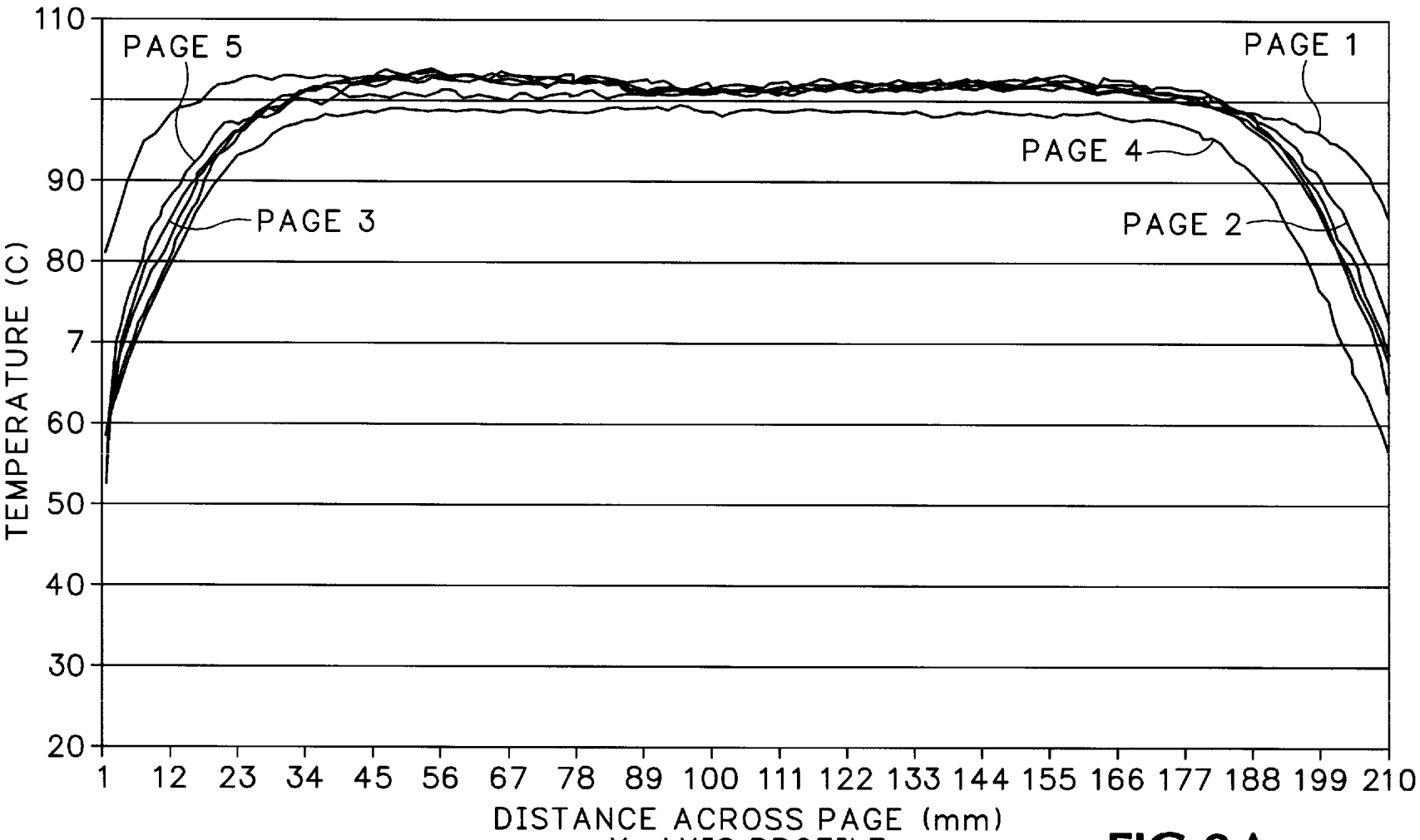
Figure 8B:
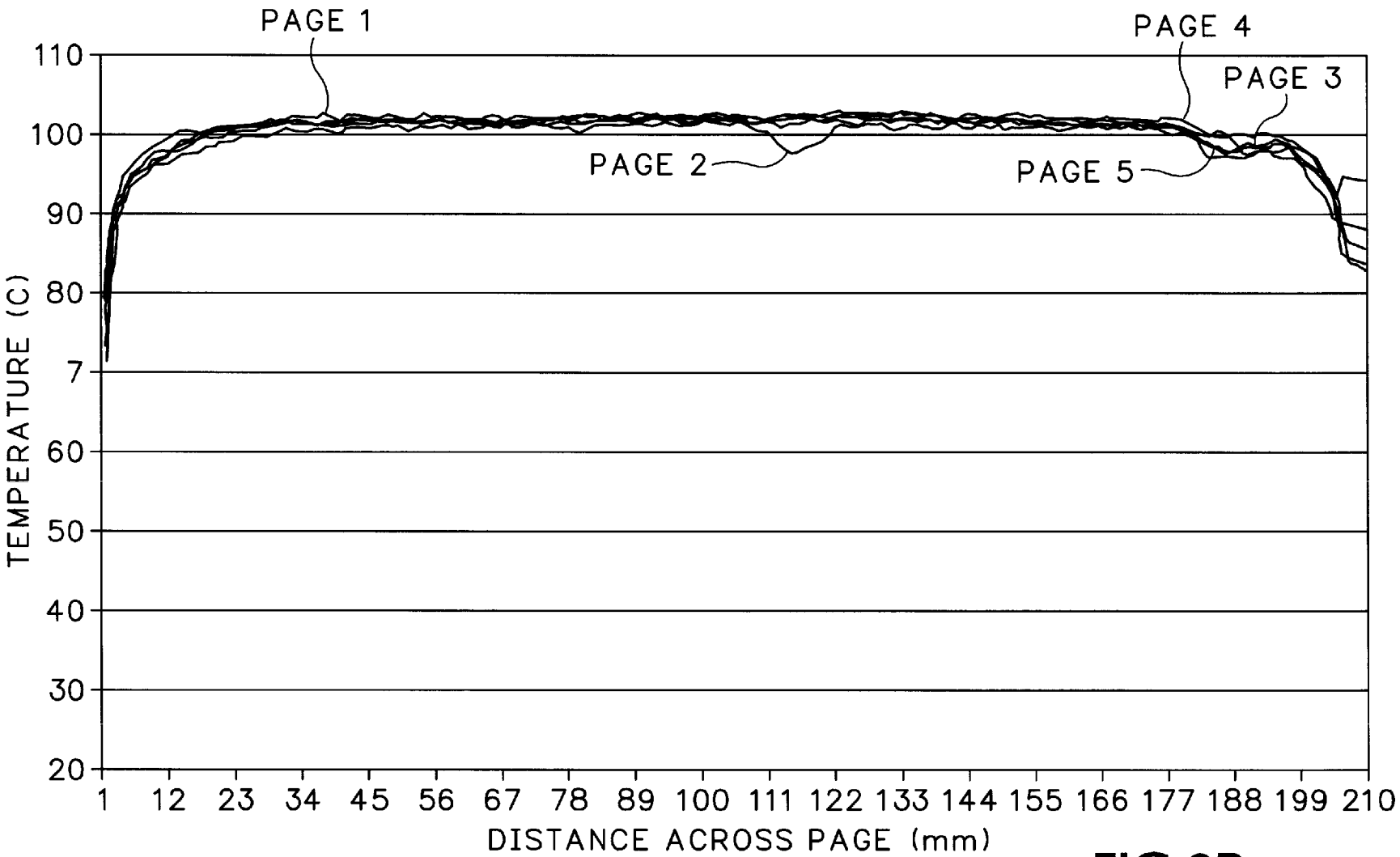

FIG. 8A is a graphic simulation for an x-axis temperature gradient of a test bed implementation such as shown in FIG. 2 in the x-axis for an embodiment having no x-axis thermal transfer mechanism subjacent the holddown-heater surface 52 of the platen 42. FIG. 8B is a graph for the same basic test bed but with heat pipes 609 (FIGS. 6 & 6A). Comparing the two drawings, the improvement in uniformity of temperature in the x-axis is very apparent.

As is known in the art of swath scanning ink-jet printing, the media is stepped through the print zone, stopping for one or more passes of the pens 20 (FIG. 1) across the sheet, then moving an appropriate distance for printing the next, adjacent swath. Another feature of the present invention is the ability to prevent damage to a sheet of paper on the platen 200/600/700 while the current page is being printed. That is, overheating of the stopped media could result in damage such as deformation or scorching. In other words, as shown in FIG. 2, the media 22 width in the x-axis may be substantially less than the platen 42 width.

In operation, whenever the controller 102 (FIG. 1 only) stops printing operations for an extended period, the valves open and the ends of the heat pipes 609 are exposed to the ambient atmosphere. Convection airflow will rapidly cool the opened heat pipes 609, pulling heat energy from under the sheet of paper on the belt, cooling the platen region beneath the sheet.

The foregoing description of the preferred embodiment of the present invention has been presented for purposes of illustration and description. It is not intended to be exhaustive or to limit the invention to the precise form or to exemplary embodiments disclosed. Many modifications and variations will be apparent to practitioners skilled in this art. Similarly, any process steps described might be interchangeable with other steps in order to achieve the same result. The disclosed embodiment was chosen and described in order to best explain the principles of the invention and its best mode practical or preferred application, thereby to enable others skilled in the art to understand the invention for various embodiments and with various modifications as are suited to the particular use or implementation contemplated. It is intended that the scope of the invention be defined by the following claims and there equivalents. Reference to an element in the singular is not intended to mean "one and only one" unless explicitly so stated, but can mean "one or more." Moreover, no element, component, nor method step in the present disclosure is intended to be dedicated to the public regardless of whether the element, component, or method step is explicitly recited in the claims. No claim element herein is to be construed under the provisions of 35 U.S.C. Sec. 112, sixth paragraph, unless the element is expressly recited using the phrase "means for . . . "

What is claimed is:

1. A method for heat treating print media, the method comprising:

establishing at least two, discrete, temperature zones on a platen in a media transit axis; and transporting the print media in the media transit axis in contact with the platen.

2. A method for anisotropically heat treating a print media to be printed with a wet colorant during transport from an input supply to an output, the method comprising:

maintaining a substantially uniform temperature profile across a colorant receiving axis; and providing a plurality of temperature regions along a media transport axis wherein each of said temperature regions has a single said substantially uniform temperature profile.

3. The method as set forth in claim 2, the step providing a plurality of temperature regions comprising:

the regions are a combination of temperature levels selected from a group including a pre-printing temperature, a printing temperature, and a post-printing temperature associated with a predetermined type of media to be printed.

4. The method as set forth in claim 2, comprising the further step of:

separating each of said regions by a temperature transition region characterized by a rapid temperature gradient between adjacent said regions.

5. The method as set forth in claim 2, the steps of providing a plurality of temperature regions further comprising:

downstream of the input and upstream of a location for printing with the wet colorant, maintaining a media platen ingress region at a first said substantially uniform temperature sufficient for pre-conditioning a sheet of said media for printing; and downstream of said ingress region, in a printing region of the platen, maintaining the media platen at a second said substantially uniform temperature for optimizing said sheet for receiving said colorant.

6. The method as set forth in claim 5, the step of providing a plurality of temperature regions further comprising:

providing a cool down region of the platen wherein the second said substantially uniform temperature is less than the first said substantially uniform temperature.

7. The method as set forth in claim 5, the step of providing a plurality of temperature regions further comprising:

downstream of said printing region in a media drying platen region, maintaining the media platen at a third said substantially uniform temperature wherein said third substantially uniform temperature is associated with rapid drying of the wet colorant on the media.

8. The method as set forth in claim 7, the step of providing a plurality of temperature regions comprising:

providing a buffer region between said printing region and said media drying platen region such that a disparate temperatures of said print region and said media drying platen region do not interact.

9. The method as set forth in claim 1 comprising the further step of:

maintaining a substantially low heat loss in a colorant deposition axis.

10. The method as set forth in claim 3, the step of maintaining a substantially low heat loss in a colorant deposition axis further comprising:

providing a platen fabricated of a thick film material having a low thermal resistance and a substantially uniform thermal profile over its thickness.

11. A method of distributing heat anisotropically across an ink-jet platen comprising:

substantially uniformly heating a pre-printing zone of a media transit axis to a first temperature for pre-conditioning print media;

substantially uniformly heating a printing zone of the media transit axis to a second temperature for printing on the print media; and providing a cool down zone between said pre-printing zone and said printing zone.

12. The method as set forth in claim 11, comprising the further steps of:

substantially uniformly heating a post-printing zone of the print media transit axis to a third temperature for drying the print media, and providing a heat buffer zone between said printing zone and said post printing zone.

13. The method as set forth in claim 11, comprising the further step of:

providing a mechanism for rapidly stabilizing at least one predetermined lateral regions of each zone when the print media is of a width less than said pre-printing zone, said printing zone, and said post-printing zone.

14. The method as set forth in claim 11, the step of substantially uniformly heating a post-printing zone of the print media transit axis to a third temperature for drying the print media further comprising:

said third temperature is equal to or greater than said second temperature.

15. The method as set forth in claim 11, comprising the steps of:

heating print media that is advanced through an ink-jet printer, having said ink jet platen having said printing zone where liquid ink is applied to the print media, by drawing a sheet of the print media against a support surface of said platen and heating the support surface anisotropically for said distributing.

16. The method as set forth in claim 15, wherein said platen is a vacuum platen and said support surface is a perforated belt associated with said support surface for transporting the sheet across the vacuum platen.

17. An anisotropically heated platen apparatus, comprising:

a heated ingress region for receiving print media superjacently thereon; and a heated printing region downstream of the ingress region for sequentially receiving the print media, wherein said ingress region is at a first predetermined temperature and said printing region is at a second predetermined temperature, said ingress region and said printing region are substantially isolated thermally such that thermal exchange therebetween is minimized.

18. The apparatus as set forth in claim 17, comprising:

a heated post-printing media egress region downstream of the printing region for sequentially receiving the print media, wherein said media egress region is at a third temperature.

19. The apparatus as set forth in claim 18, comprising:

said third temperature is equal to the second temperature.

20. The apparatus as set forth in claim 18, comprising:

said third temperature is greater than said second temperature, and said printing region and said egress region are substantially isolated thermally such that no thermal exchange occurs therebetween.

21. The apparatus as set forth in claim 17, comprising:

a construct including a vacuum platen having a media support surface, a perforated transport belt slidingly transiting said surface in a paper transport axis, a plurality of individually selectable heaters distributed in a predetermined pattern across said surface, and subjacent said heaters, a heat transfer mechanism for rapidly distributing heat across said surface perpendicularly to said paper transport axis.

22. The apparatus as set forth in claim 21, comprising:

said platen defining an x-axis in which liquid colorant deposition forms a plurality of dot matrix pixels, and a y-axis, perpendicular to said x-axis, being said paper transport axis in which print media is transported during said liquid colorant deposition; and said media support surface having at least one of said individually selectable heaters arranged for forming a print media pre-printing zone at said ingress region, said pre-printing zone having a first substantially uniform temperature in the x-axis and y-axis.

23. The apparatus as set forth in claim 22 comprising:

said media support surface having at least one of said individually selectable heaters arranged for forming a print media printing zone at said printing region, downstream in said y-axis from said pre-printing zone, said printing zone having a second substantially uniform temperature in the x-axis and y-axis.

24. The apparatus as set forth in claim 23 further comprising:

said media support surface having a first thermally passive buffer zone between said pre-printing zone and said printing zone such that there is substantially zero thermal conductivity therebetween.

25. The apparatus as set forth in claim 23, comprising:

said media support surface having at least one of said individually selectable heaters arranged for forming a print media post-printing zone downstream in said y-axis from said printing zone, said post-print zone having a third substantially uniform temperature in the x-axis and y-axis.

26. The apparatus as set forth in claim 25, comprising:

said media support surface having a second thermally passive buffer zone between said printing zone and said post-printing zone such that there is substantially zero thermal conductivity therebetween.

27. The apparatus as set forth in claim 21, the heat transfer mechanism further comprising:

a heat pipe subsystem.

28. The apparatus as set forth in claim 21, the heat transfer mechanism further comprising:

a set of heat conduits each having a high thermal conductivity characteristic.

29. The apparatus as set forth in claim 28, the first buffer zone comprising:

thermally insulative gaps in said heat conduits extending subjacently from said platen.

30. The apparatus as set forth in claim 29, comprising:

uniform heating in the orthogonal axes is established using heat transfer mechanisms subjacent an array of platen surface heaters.

31. The apparatus as set forth in claim 21, the platen further comprising:

a thick film planar construct having a plurality of vacuum ports distributed between the heaters, fabricated of a material having a z-axis low thermal resistance.

32. A liquid colorant print media platen apparatus, comprising:

sequentially in a media transit axis, a first region substantially uniformly heated in orthogonal axes to a first predetermined temperature for preconditioning print media, a second region that is unheated, and a third region substantially uniformly heated in like orthogonal axes to a second predetermined temperature for depositing said colorant on the print media, wherein anisotropic print media heat conditioning occurs on said platen.

33. The apparatus as set forth in claim 32, further comprising:

a fourth region that is unheated, and a fifth region substantially uniformly heated in like orthogonal axes to a third predetermined temperature for drying the print media.

34. An ink-jet hard copy apparatus, having a known manner means for inducing a vacuum force, comprising:

at least one ink-jet writing instrument for depositing ink drops onto pixels of an adjacently positioned sheet of print media;

adjacent to said writing instrument, a print media platen including a thick film transport surface, having vacuum ports in a first array;

mounted to the platen, individually selectable heaters in a second array interspersed with said first array;

a perforated print media transport belt for sliding across said surface for carrying said sheet via vacuum adhesion sequentially from an input position to a position of being adjacently positioned to said writing instrument to an output receiver; and a controller connected to said heaters for forming at least two segregated, anisotropic, print media heating regions on said platen surface.

35. The apparatus as set forth in claim 34, further comprising:

heat transfer mechanisms associated with said heaters for rapidly establishing uniform temperature profiles in each of said regions.

36. The apparatus as set forth in claim 35, the heat transfer mechanisms further comprising:

means for selectively cooling individual heat transfer mechanisms.

* * * * *

UNITED STATES PATENT AND TRADEMARK OFFICE

CERTIFICATE OF CORRECTION

PATENT NO. : 6,406,140 B1
DATED : June 18, 2002
INVENTOR(S) : Wotton et al.

It is certified that error appears in the above-identified patent and that said Letters Patent is hereby corrected as shown below:

Column 1,
Line 38, "Bleed" should read -- *Bleed* --;
Line 40, "smearing" should read -- *smearing* --;
Line 41, "cockle" should read -- *cockle* --;
Line 61, "a s a" should read -- as a --;

Column 2,
Line 1, "i s sued" should read -- issued --;
Line 8, "09/1412842" should read -- 09/412842 --;
Line 10, "it s" should read -- its --;
Lines 59 and 62, "W/m.K" should read -- W/m•K --;
Line 59, "Watts/meter.Kelvin" should read -- Watts/meter•Kelvin --;

Column 3,
Lines 3-4, "surface
temperature" should read -- surface temperature -- (no new paragraph);
Lines 14 and 22-23, "mass-specific heat" should read -- mass • specific heat --;

Column 6,
Line 58, "supra" should read -- *supra* --;

Column 10,
Line 58, "1A-1B.2" should read -- 1A-1B, 2 --;

Column 12,
Line 46, "10. The method as set forth in claim 3, the step of" should read
-- 10. The method as set forth in claim 9, the step of --

Signed and Sealed this

Thirteenth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,406,140 B1
DATED : June 18, 2002
INVENTOR(S) : Wotton et al.

It is certified that error appears in the above-identified patent and that said Letters Patent is hereby corrected as shown below:

Column 1,
Line 19, "1992," should read -- 1992), --;

Column 2,
Line 36, "temperatures" should read -- temperature --;

Column 4,
Line 38, "position" should read -- position; --;

Column 7,
Line 22, "represents" should read -- represent --;

Column 10,
Line 23, "implementations" should read -- implementation --;

Column 11,
Line 39, "there" should read -- their --;

Column 12,
Line 40, "temperatures" should read -- temperature --;

Signed and Sealed this

Fifth Day of October, 2004

JON W. DUDAS
*Director of the United States Patent and Trademark Office*